United States Patent [19]

Sasaki

[11] Patent Number: 5,075,209

[45] Date of Patent: Dec. 24, 1991

[54] SILVER HALIDE PHOTOGRAPHIC LIGHT-SENSITIVE MATERIAL

[75] Inventor: Takayuki Sasaki, Hino, Japan

[73] Assignee: Konica Corporation, Tokyo, Japan

[21] Appl. No.: 567,931

[22] Filed: Aug. 15, 1990

[30] Foreign Application Priority Data

Aug. 29, 1989 [JP] Japan ..... 1-223473

[51] Int. Cl.[5] ..... G03C 1/18

[52] U.S. Cl. ..... 430/587; 430/546; 430/633; 430/637; 430/638

[58] Field of Search ..... 430/587, 633, 637, 638, 430/546

[56] References Cited

U.S. PATENT DOCUMENTS 2,960,404 11/1960 Milton et al. ..... 430/638
4,292,402 9/1981 Pollet et al. ..... 430/631
4,547,459 10/1985 Kamio et al. ..... 430/631
4,818,676 4/1989 Baba et al. ..... 430/574
4,925,780 5/1990 Yoshizawa et al. ..... 430/589

*Primary Examiner*—Charles L. Bowers, Jr.
*Assistant Examiner*—Janet C. Baxter
*Attorney, Agent, or Firm*—Frishauf, Holtz, Goodman & Woodward

[57] ABSTRACT

A silver halide photographic light-sensitive material is disclosed, which has high sensitivity, high contrast and improved standing stability in the manufacturing process. The light-sensitive material has a silver halide emulsion layer and silver halide grains contained in the emulsion layer are spectrally sensitized by a specific sensitizing dye dissolved in a chain hydrocarbon compound having two or more more hydroxy groups or a mixture of the hydrocarbon compound and a water-miscible solvent.

12 Claims, No Drawings

SILVER HALIDE PHOTOGRAPHIC LIGHT-SENSITIVE MATERIAL

FIELD OF THE INVENTION

This invention relates to a method of spectral sensitization of a silver halide photographic emulsion, particularly to a silver halide photographic light-sensitive material having a high sensitivity, high contrast and improved standing stability of a coating emulsion thereof.

BACKGROUND OF THE INVENTION

Recently, there has come known a method in which medical and diagnostic radiographic images are converted into a digital format that is picture-processed with a computer into a proper form for diagnoses, and then, reproduced into images on a light-sensitive material by exposure of laser beams.

In emergency medical area that strongly requires a rapid and correct diagnosis, rapid processing and high quality images are essential conditions of a light-sensitive material used.

This is the same with a silver halide photographic light-sensitive material for laser scanning. Therefore, it is necessary to develop a silver halide light-sensitive material having a much higher sensitivity and capable of providing images of much higher quality.

The present inventors proposed, in Japanese Patent Application No. 139607/1989, a method to improve sensitivity, gradation and graininess by optically sensitizing a specific silver halide emulsion with a specific carbocyanine.

By the way, in the manufacture of silver halide photographic light-sensitive material, coating emulsions are usually made to stand for several hours between the preparation thereof and the completion of coating. Therefore, stability of photographic characteristics for a long time is essential for a coating emulsion in use of mass production.

The above-mentioned method, however, had a disadvantage that a prolonged standing of a coating emulsion caused an increase in fog and a decrease in sensitivity, though the coating emulsion had satisfactory performance shortly after the preparation thereof.

SUMMARY OF THE INVENTION

The object of the present invention is to provide a silver halide photographic light-sensitive material which has a high sensitivity and a high contrast and is improved in the standing stability of coating emulsion in the manufacturing process. Other objects of the invention will be clarified as the description of the specification proceeds.

The object of the invention can be attained by the silver halide photographic light-sensitive material comprising a support having thereon, a silver halide emulsion layer containing silver halide grains which are spectrally sensitized with a sensitizing dye represented by the following Formula I dissolved in a chain hydrocarbon compound having two or more hydroxy groups, or, in a mixture of the said compound and a water-miscible solvent,

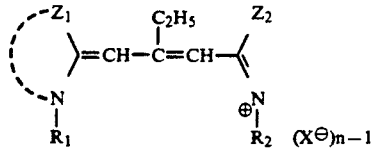

Formula I wherein $Z_1$ and $Z_2$ are independently a group of atoms necessary to form a benzothiazole nucleus, a benzoselenazole nucleus, a naphthothiazole nucleus or a naphthoselenazole nucleus, and each of the said nuclei may have a substituent; $R_1$ and $R_2$ are independently a substituted or unsubstituted lower alkyl group; $X^{\ominus}$is an anion; and n is a an integer of 1 or 2, or n is 1, provided that an intramolecular salt is formed.

DETAILED DESCRIPTION OF THE INVENTION

In Formula I, $Z_1$ and $Z_2$ independently represent a group of atoms necessary to from a substituted or unsubstituted benzothiazole nucleus, benzoselenazole nucleus, naphthothiazole nucleus or naphthoselenazole nucleus. Examples of the benzothiazole nucleus are benzothiazole, 5-chlorobenzothiazole, 5-methylbenzothiazole, 5-methoxybenzothiazole, 5-hydroxybenzothiazole, 5-hydroxy-6-methylbenzothiazole, 5,6-dimethylbenzothiazole, 5-ethoxy-6-methylbenzothiazole, 5-phenylbenzothiazole, 5-carboxybenzothiazole, 5-ethoxycarbonylbenzothiazole, 5-dimethylaminobenzothiazole and 5-acetylaminobenzothiazole; examples of the benzoselenazole nucleus are benzoselenazole, 5-chlorobenzoselenazole, 5-methylbenzoselenazole, 5-methoxybenzoselenazole, 5-hydroxybenzoselenazole, 5,6-dimethylbenzoselenazole, 5,6-dimethoxybenzoselenazole, 5-ethoxy-6-methylbenzoselenazole, 5-hydroxy-6-methylbenzoselenazole and 5-phenylbenzoselenazole; examples of the naphthothiazole nucleus are $\beta$-naphthothiazole and $\beta$, $\beta$-naphthothiazole; and an example of the naphthoselenazole nucleus is $\beta$-naphthoselenazole. $R_1$ and $R_2$ independently represent a substituted or unsubstituted lower alkyl group, and examples of which are a methyl group, ethyl group, n-propyl group, $\beta$-hydroxyethyl group, $\beta$- carboxyethyl group, $\gamma$-oarboxypropyl group, $\gamma$-sulfopropyl group, $\gamma$-sulfobulyl group, $\delta$-sulfobutyl group and sulfoethoxyethyl group.

$X^{\ominus}$represents an anion and includes a halogen ion, perchlorate ion, thiocyanate ion, benzenesulfonate ion, p-toluenesulfonate ion and methylsulfate ion. And n represents an integer of 1 or 2, but n is 1 when the said dye forms an intramolecular salt.

The sensitizing dyes of the invention are thia- or selena-carbocyanines which are substituted with an ethyl group on the meso position of the trimethyne chain and have effective capability for sensitizing silver halide in a specific wavelength region.

Typical examples of the sensitizing dyes of the invention are as follows.

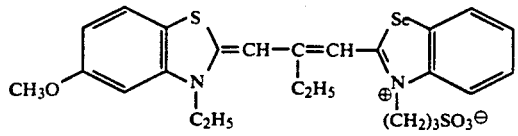

(1)

-continued
(2)
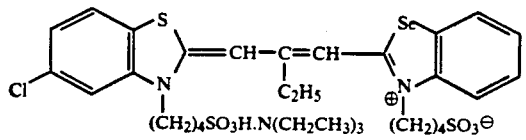
(3)
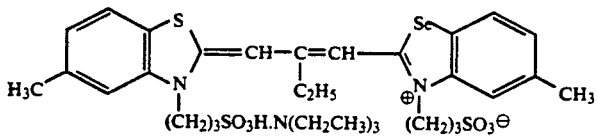
(4)
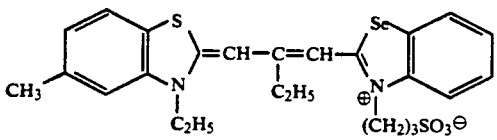
(5)
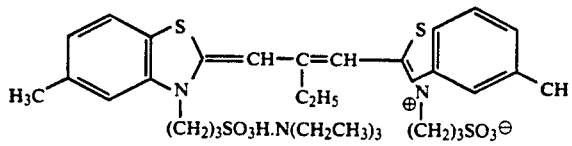
(6)
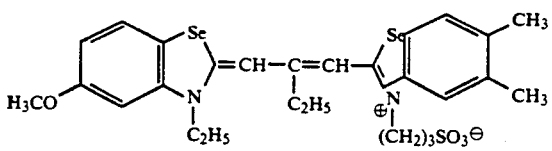
(7)
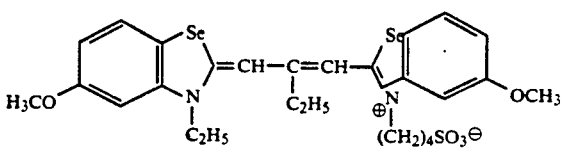
(8)
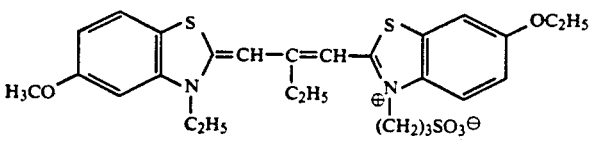
(9)
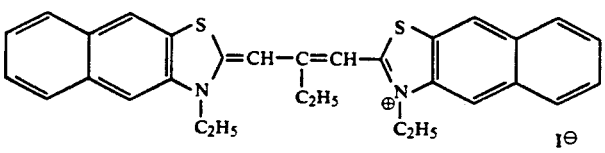
(10)
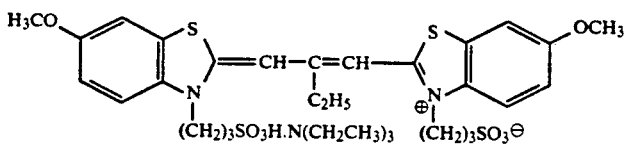
(11)
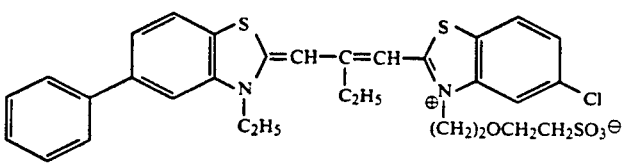

-continued
(12)
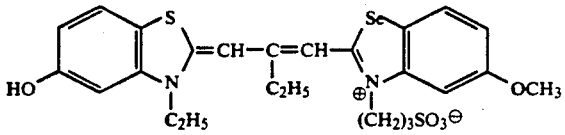
(13)
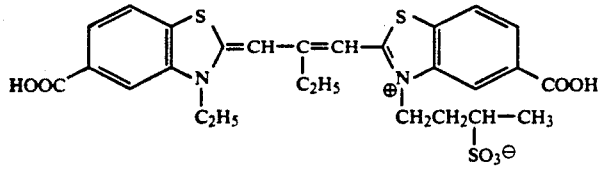
(14)
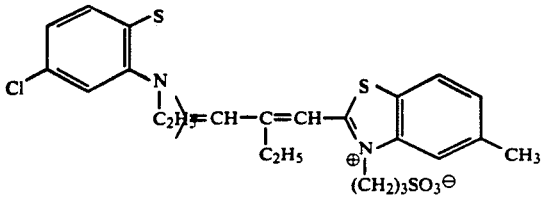
(15)
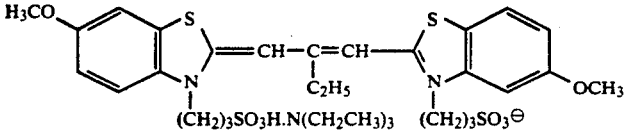
(16)
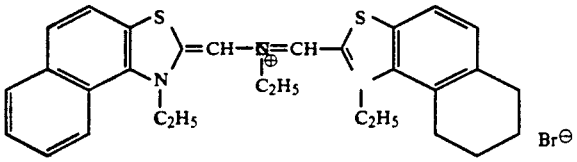
(17)
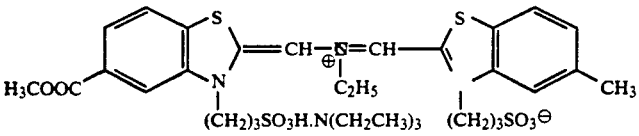
(18)
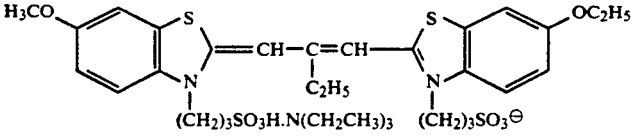
(19)
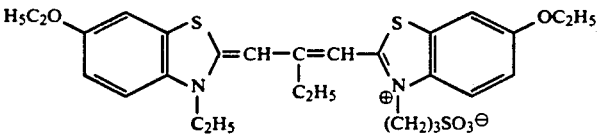
(20)
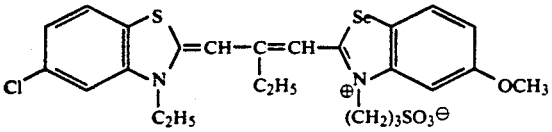
(21)
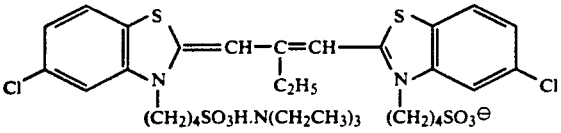

-continued
(22)
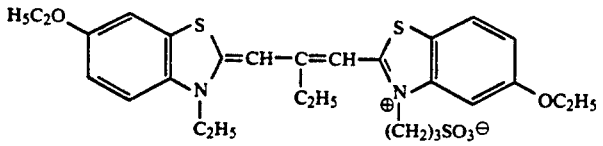
(23)
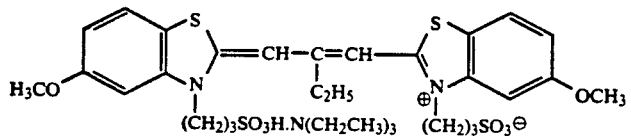
(24)
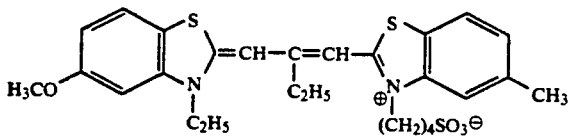
(25)
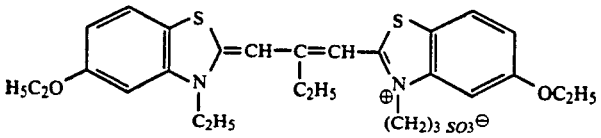
(26)
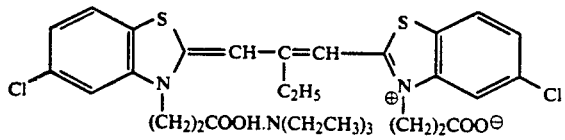
(27)
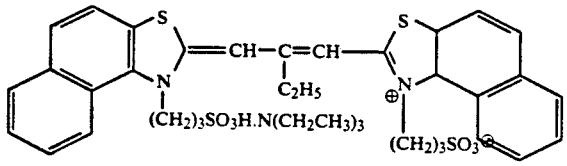
(28)
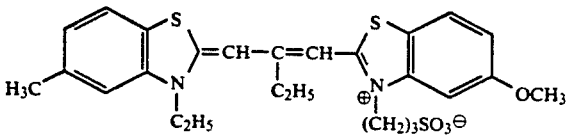
(29)
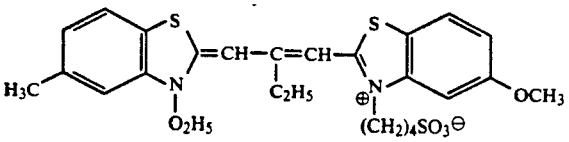
(30)
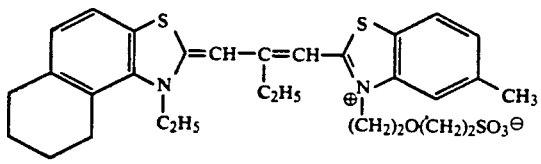
(31)
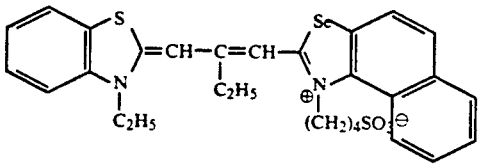

-continued (32)

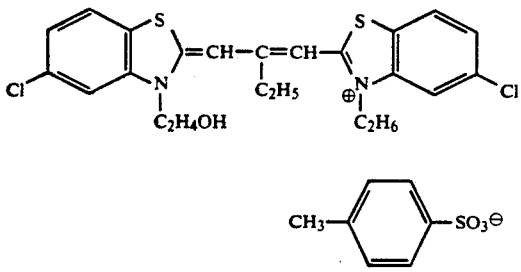

These sensitizing dyes of the invention can be synthesized by methods described in British Patent No. 660,408 and U.S. Pat. No. 3,149,105.

The above spectrally sensitizing dyes are dissolved in a chain hydrocarbon compound having two or more hydroxy groups or in a mixture of the compound and a hydrophilic solvent, and then added to a silver halide photographic light-sensitive material.

The chain compound with two or more hydroxy groups according to the invention is preferbly an aliphatic hydrocarbon compound substituted by two or more hydroxy groups and having 1 to 18, more preferably 1 to 12, carbon atoms. Examples of the chain compound are shown below.

1. Ethylene glycol
2. Trimethylene glycol
3. Propylene glycol
4. Butylene glycol
5. Pentamethylene glycol
6. Triethylene glycol
7. Hexamethylene glycol
8. Decamethylene glycol
9. Glycerol
10.-methyl glycerol
11. Erythritol
12. 1,2,3,4-pentane tetrol
13. 2,3,3,4-tetramethyl-2,4-4 pentane diol
14. 2,2,4-trimethyl-1,3-pentane diol
15. 2,4-dimethyl-2,3,4-hexane triol
16. Trimethylolpropane The above compounds are known as a polyol-type organic solvent and available in market.

In embodying the present invention, ethylene glycol and glycerol are particularly preferable among the above compounds.

Of these compounds, solid ones at the normal temperature may be dissolved before use in a hydrophilic solvent such as methanol, ethanol, propanol, methyl Cellosolve, halogenated alcohols, acetone, pyridine or water.

Water-miscible solvents that may be used together with the above chain hydrocarbon compounds having two or more hydroxy groups may be the foregoing hydrophilic solvents, and methanol, ethanol and acetone can be favorably used.

An amount of chain hydrocarbon compound having two or more hydroxy group to be used, varies depending upon the type and amount of spectrally sensitizing dyes used. When the chain hydrocarbon compound is added to a silver halide emulsion, a range of 0.01 to 200 g per mol of silver halide is serviceable; preferably, an addition of 0.1 to 80 g per mol works effectively. The amount of the water-miscible solvent to be used with the chain hydrocarbon compound having two or more hydroxy groups is preferably 0.01 to 200 g, more preferably 0.1 to 80 g per mol of silver halide.

Although an amount of the sensitizing dyes added to a silver halide emulsion fluctuates depending upon the type and silver content of silver halide, it is preferably 0.005 to 1.0 g per mol of silver halide, particularly preferably 0.01 to 0.6 g.

These sensitizing dyes are incorporated into a silver halide emulsion singly or in combination by the method of the present invention to ensure a desired spectral sensitivity.

Incorporation of the sensitizing dyes may be made at any time between before the termination of desalination and before the termination of chemical aging, and it is favorably carried out during the chemical aging process, more favorably at the beginning of the chemical aging process.

Desalination may be performed by any method of prior art, for example, a noodle washing method or a flocculation method described in Research Disclosure 17643 (1978, p. 23, left column II) may be used.

As a favorable embodiment of the invention, a fluorine-containing surfactant is used in at least one layer of the silver halide photographic light-sensitive material of the invention to enhance effect of the invention.

The fluorine-containing surfactant includes an anionic surfactant, a cationic surfactant, a nonionic surfactant and an amphoteric surfactant having a betaine structure; and preferably contains a fluoroalkyl group having four or more carbon atoms.

The above anionic surfactant includes sulfonates, carboxylates and phosphates; the cationic surfactant includes amine salts, ammonium salts, sulfonium salts, phosphonium salts and aromatic amine salts; the nonionic surfactant includes those which contain a polyalkyleneoxide group or a polyglyceryl group; and the amphoteric surfactant includes those which have a betain structure.

Examples of these fluorine-containing surfactant are described in U.S. Pat. Nos. 4,335,201, 4,347,308, British Patent Nos. 1,417,915, 1,439,402, Japanese Patent Examined Publication Nos. 26687/1977, 26719/1982, 38573/1984 and Japanese Patent Publication Open to Public Inspection (hereinafter referred to as Japanese Patent O.P.I. Publication) Nos. 149938/1980, 48520/1979, 14224/1979, 200235/1983, 146248/1982, 196544/1983.

Preferable examples of these fluorine-containing surfactants are as follows.

| | |
|---|---|
| $C_8F_{17}SO_3K$ | F-1 |
| $C_7F_{15}COONa$ | F-2 |
| $C_8F_{17}CH_2CH_2OSO_3Na$ | F-3 |

-continued

F-4

$$C_8F_{17}SO_2N(C_3H_7)-CH_2COOK$$

F-5

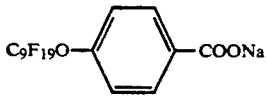

F-6

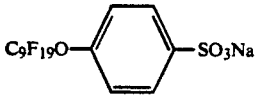

F-7

$$C_8F_{17}SO_2N(C_3H_7)\text{-}(CH_2CH_2O)_4\text{-}(CH_2)_4\text{-}SO_3Na$$

F-8

$$C_8F_{17}SO_2N(C_3H_7)CH_2CH_2O-P(=O)(ONa)-ONa$$

F-9

$$C_{10}F_{21}COOCH_2CH(OH)CH_2SO_3Na$$

F-10

$$H(CF_2)_6CH_2OOC-CH_2$$
$$H(CF_2)_6CH_2OOC-CH(SO_3Na)$$

F-11

$$C_8F_{17}CH_2CH_2OOC-CH_2$$
$$C_4H_9OOC-CH(SO_3Na)$$

F-12

$$C_8F_{17}SO_2N(H)CH_2CH_2\overset{\oplus}{N}(CH_3)_2-CH_2COO^{\ominus}$$

F-13

$$C_8F_{17}SO_2N(H)CH_2CH_2CH_2OCH_2CH_2\overset{\oplus}{N}(CH_3)_2-CH_2COO^{\ominus}$$

F-14

$$C_8F_{17}SO_2N(H)CH_2CH_2CH_2OCH_2CH_2\overset{\oplus}{N}(CH_3)_2-CH_2CH_2COO^{\ominus}$$

F-15

$$C_7F_{15}CON(H)CH_2CH_2\overset{\oplus}{N}(CH_3)_2-CH_2COO^{\ominus}$$

F-16

$$H(CF_2)_{10}CON(CH_3)CH_2CH_2\overset{\oplus}{N}(CH_3)_2-CH_2COO^{\ominus}$$

F-17

$$C_8F_{17}SO_2N(H)CH_2CH_2\overset{\oplus}{N}(CH_3)_2-CH_2CH_2SO_3^{\ominus}$$

F-18

$$C_8F_{17}SO_2N(H)CH_2CH_2CH_2-\overset{\oplus}{N}(CH_3)_2(CH_2)_4SO_3^{\ominus}$$

F-19

$$C_8F_{17}SO_2N(H)CH_2CH_2CH_2\overset{\oplus}{N}(CH_2CH_2OH)_2-CH_2COO^{\ominus}$$

-continued

F-20

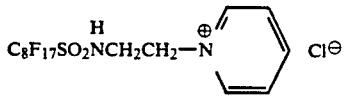

F-21

$$C_8F_{17}SO_2N(H)CH_2CH_2\overset{\oplus}{N}(CH_3)_3\ I^{\ominus}$$

F-22

$$C_8F_{17}SO_2N(H)CH_2CH_2CH_2OCH_2CH_2\overset{\oplus}{N}(CH_3)_3$$

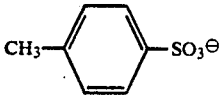

F-23

$$C_7F_{15}CON(C_3H_7)CH_2CH_2\overset{\oplus}{N}(C_2H_5)_3\ Cl^{\ominus}$$

F-24

$$C_{10}F_{21}SO_2-N(CH_2CH_2OH)-CH_2CH_2CH_2\overset{\oplus}{N}(CH_3)CH_2CH_2OH\ Br^{\ominus}$$

F-25

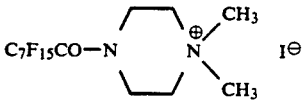

F-26

$$C_7F_{15}COO\text{-}(CH_2CH_2O)_{10}\text{-}H$$

F-27

$$C_{10}F_{21}COO\text{-}(CH_2CH_2O)_{10}\text{-}H$$

F-28

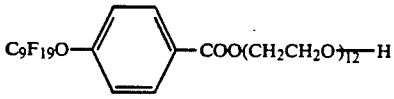

F-29

$$C_8F_{17}SO_2N(CH_3)\text{-}(CH_2CH_2O)_9H$$

F-30

$$C_8F_{17}SO_2N(CH_3)\text{-}(CH_2CH_2O)_{12}\text{-}H$$

F-31

$$C_6F_{13}SO_2N\langle(CH_2CH_2O)_nH,\ (CH_2CH_2O)_mH\rangle \qquad n + m = 11$$

F-32

$$C_8F_{17}SO_2N(C_3H_7)\text{-}(CH_2CH_2O)_{15}\text{-}H$$

F-33

$$C_8F_{17}SO_2N(C_2H_5)\text{-}(CH(CH_3)-CH_2-O)_3\text{-}(CH_2CH_2O)_{13}\text{-}H$$

F-34

$$C_8F_{17}CH_2CH_2O\text{-}(CH_2CH_2O)_{12}\text{-}H$$

F-35

$$C_8F_{17}SO_2N(C_3H_7)-CH_2COO\text{-}(CH_2CH_2O)_9H$$

-continued

F-36 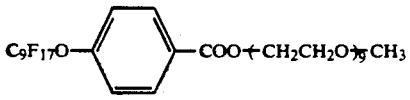

F-37 $C_9F_{19}O(CH_2CH_2O)_{15}CH_3$

F-38 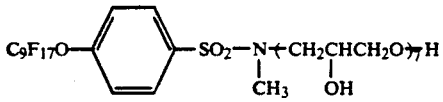

F-39 $C_7F_{15}COO(CH_2\underset{\underset{CH_3}{|}}{C}H-O)_{14}(CH_2CH_2O)_{20}-H$ The foregoing fluorine-containing surfactants may be added to any layer of a silver halide photographic light-sensitive material. For example, they can be added to a nonlight-sensitive layer such as surface protection layer, intermediate layer, subbing layer or backing layer; or a silver halide emulsion layer. However, it is preferable to added them to an emulsion layer and/or its protective layer, or, a backing layer and/or its protective layer.

These fluorine-containing surfactants may be used in combination of two or more of them, or together with synthetic surfactents of other kind. The addition amount, though varying according to the type of fluorine-containing surfactant, is 0.0001 to 2 g per $m^2$ of silver halide light-sensitive emulsion layer of the invention, preferably 0.001 to 0.5 g per $m^2$. When the fluorine-containing surfactants are added to a hydrophilic colloid layer other than an emulsion layer, an addition amount is 0.0001 to 2 g per $m^2$, preferably 0.001 to 0.5 g per $m^2$.

Next, the silver halide emulsion according to the invention is described below.

In a hydrophilic colloid layer of the light-sensitive material of the invention, a vinylsulfone type compound can be favorably employed as a gelatin hardener. Such a vinylsulfone type hardener may be any of those which have at least two vinylsulfone groups in the molecule, but the particularly effective is a compound represented by the following Formula H:

$$[CH_2{=}CHSO_2\underset{\underset{R}{|}}{C}H)_m]_nZ \qquad \text{Formula H}$$

wherein R is a hydrogen atom or a lower alkyl group, preferably a hydrogen atom or a methyl group; Z is a n-valent atomic group containing at least one of oxygen, nitrogen and sulfur atoms, preferably an oxygen atom or a nitrogen atom; m is 1 or 2; and n is 2 or 3.

Examples of the compound represented by Formula H are as follows:

$CH_2{=}CHSO_2CH_2OCH_2SO_2CH{=}CH_2$ H-1

$CH_2{=}CHSO_2CH_2CH_2CH_2CH_2OCH_2CH_2CH_2CH_2SO_2CH{=}CH_2$ H-2

$CH_2{=}CHSO_2CH_2CH_2OCH_2CH_2OCH_2CH_2SO_2CH{=}CH_2$ H-3

$CH_2{=}CHSO_2CH_2CH_2OCH_2CH_2NHCONHCH_2CH_2OCH_2CH_2SO_2CH{=}CH_2$ H-4

$CH_2{=}CHSO_2CH_2OCH_2CH_2\underset{\underset{CH_3}{|}}{N}CH_2CH_2SO_2CH{=}CH_2$ H-5

H-6

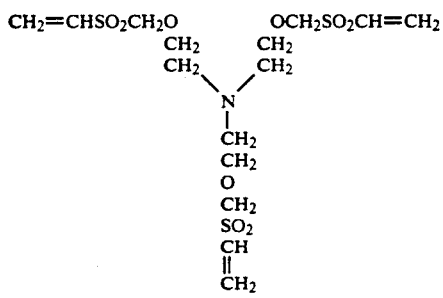

H-7

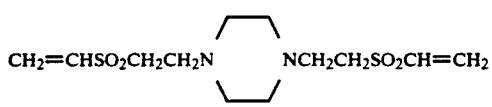

$CH_2{=}CHSO_2CH_2OCH_2CH_2SO_2CH_2CH_2OCH_2SO_2CH{=}CH_2$ H-8

$CH_2{=}CHSO_2CH_2SO_2CH{=}CH_2$ H-9

$CH_2{=}CHSO_2CH_2CH_2SO_2CH{=}CH_2$ H-10

H-11

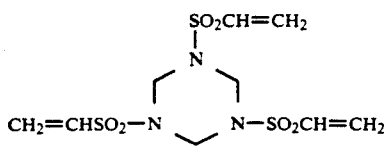

-continued
$CH_2{=}CHSO_2CH_2CH(OH)CH_2CH_2SO_2CH{=}CH_2$ H-12
$CH_2{=}CHSO_2CH_2CONHCH_2CH_2NHCOCH_2SO_2CH{=}CH_2$ H-13
$(CH_2{=}CHSO_2CH_2CH_2O{-}CH_2CH_2)_2SO_2$ H-14
$[(CH_2{=}CHSO_2CH_2)_3CCH_2SO_2CH_2CH_2]_2N{-}CH_2CH_2SO_3K$ H-15
H-16
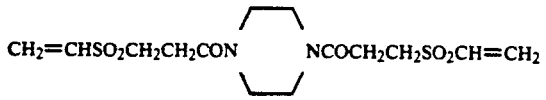
$(CH_2{=}CHSO_2CH_2)_2C(CH_2SO_2CH_2CH_2OSO_3Na)_2$ H-17
H-18
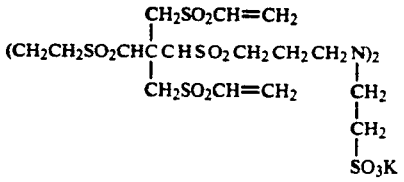
H-19
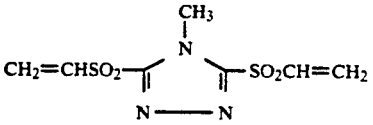
$(CH_2{=}CHSO_2CH_2)_4C$ H-20
$CO(CH_2CH_2SO_2CH{=}CH_2)_2$ H-21
$NH(CH_2CH_2SO_2CH{=}CH_2)_2$ H-22
H-23
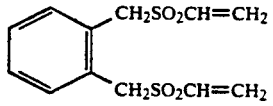
H-24
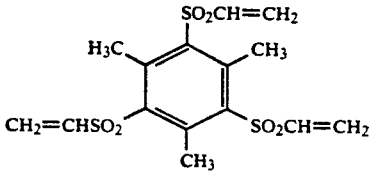
H-25
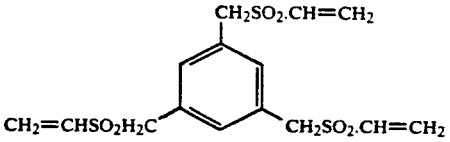
H-26
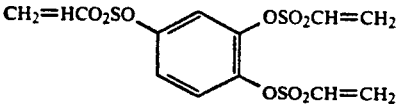
H-27
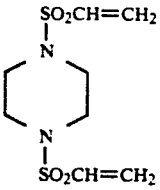

-continued $CH_3C(CH_2OCH_2SO_2CH{=}CH_2)_3$ H-28

$N(CH_2CH_2OCH_2SO_2CH{=}CH_2)_3$ H-29

$H_{17}C_8{-}C(CH_2SO_2CH{=}CH_2)_3$ H-30

$CH_2{=}CHSO_2CH_2CH(SO_2CH{=}CH_2)CH_2SO_2CH{=}CH_2$ H-31

$BrH_2C{-}C(CH_2SO_2CH{=}CH_2)_3$ H-32

$(CH_2{=}CHSO_2CH_2)_2CH{-}CH(CH_2SO_2CH{=}CH_2)_2$ H-33

$(CH_2{=}CHSO_2CH_2)_3C{-}CH_2OCH_2C(CH_2SO_2CH{=}CH_2)_3$ H-34

$(CH_2{=}CHSO_2CH_2)_3C{-}CH_2SO_2CH_2CH_2Cl$ H-35

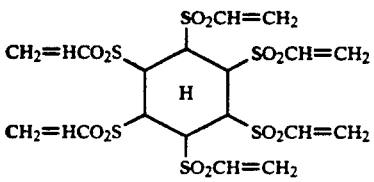

H-36

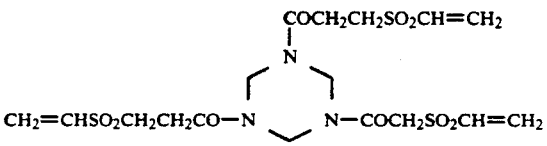

H-37

$CH_2{=}CHSO_2(CH_2)_4SO_2CH{=}CH_2$ H-38

Preferable vinylsulfone type hardeners usable in the invention include such aromatic compounds as are described in German Patent No. 1,100,942; such heteroatom-containing compounds each comprising alkyl groups linked by a hetero-atom as are described in Japanese Patent Examined Publication Nos. 29622/1969 and 25373/1972; such sulfonamides and esters as are described in Japanese Patent Examined Publication No. 8736/1972; such 1,3,5-tris[β-vinylsulfonyl-propionyl]-hexahydro-s-triazine as is described in Japanese Patent 0.P.I. publication No. 24435/1974; and such alkyl compounds as are described in Japanese Patent 0.P.I. Publication No. 44164/1976.

In addition to the above examples, the vinylsulfone type hardeners that may be used in the invention include reaction products between a compound having at least three vinylsulfone groups in the molecule and a compound having a hydrophilic group and a group capable of reacting with a vinylsulfone group (such as diethanolamine, thioglycolic acid, sarcosine sidium salt or taurine sodium salt).

The emulsion used in a silver halide photographic light-sensitive material of the invention may contain any silver halide such as silver bromoiodide, silver chloroiodide or silver bromochloroiodide, but silver bromoiodide has an advantage of providing a high sensitivity.

The silver halide grains in the emulsion may be any of isotropic crystals having a shape of cube, octahedron or tetradecahedron; multiface crystals having a nearly spherical shape; twinned crystals having plane defects; and mixtures or composites of these crystal forms. The size of these silver halide grains may range from fine grains with a grain size of less than 0.1 μm to large grains of 20 μm grain size.

The emulsion according to the invention may be prepared by a conventional method. It can be prepared, for example, by a method described in "Emulsion Preparation and Types" on pages 22 to 23 of Research Disclosure No. 17643 (1978, Dec.) and on page 648 of Research Disclosure No. 18716 (1979, Nov.). Other methods applicable to the preparation of the emulsion are described in, for example, "The Theory of the Photographic Process "4th Edition, pp. 38 to 104, (written by T.H. James, published by Macmillan in 1977), "Photographic Emulsion Chemistry" (written by G.F. Dauffin, published by Focal Press in 1966), "Chimie et Physique Photograhique" (written by P.Glafkides, published by Paul Montel in 1967) and "Making and Coating Photographic Emulsion" (written by V.L. Zelikman, published by Focal Press in 1964).

In other words, the emulsion can be prepared by a combination of solution preparation conditions such as neutral method, acid method and ammonia method; mixing controlling conditions such as normal precipitation method, reverse precipitation method, double jet method and controlled double jet method; and grain preparation conditions such as conversion method and core/shell method.

The silver halide grains may have silver halide compositions different from the inner part to the outer part.

A preferable embodiment of the invention is in a monodispesed emulsion containing silver halid prains in each of which silver iodide is localized at the inner part thereof. The term "monodispersed emulsion" used herein is intended to mean an emulsion in which at least 95% by number or by weight of the silver halide grains have a size within the average grain size ±40%, preferably within the average grain size ±30%. The grain size distribution of silver halide may be either a monodispersed emulsion with a narrow distribution or a multidispersed emulsion with a wide distribution.

A preferable emulsion in the invention is a monodispersed emulsion having distinct core/shell structure, which consists of a core having a higher silver iodide content and an outer shell having a lower silver iodide content. A favorable silver iodide content in the core according to the invention is 20 to 40 mol%, the particularly favorable is 20 to 30 mol%.

Such a monodispersed emulsion can be prepared by conventional methods described in, for example, Journal of Photographic Science, Vol. 12, pp. 242 to 251 (1963), Japanese Patent O.P.I. Publication Nos. 36890/1773, 16364/1977, 142329/1980, 49938/1983, British Patent No. 1,413,748 and U.S. Pat. Nos. 3,574,628, 3,655,394.

The monodispersed emulsion of the invention is preferably grown from a seed emulsion by means of providing seed crystals with silver ions and halide ions. A core/shell structure emulsion can be prepared by such methods as are described in British Patent No. 1,027,146, U.S. Pat. Nos. 3,505,068, 4,444,877 and Japanese Patent O.P.I. Publication No. 14331/1985.

The silver halide emulsion used in the invention may comprise of tabular grains having an aspect ratio not less than 5.

Such tabular grains have advantages to enhance sensitivity and improve graininess and sharpness of images, and can be prepared by methods described in, for example, British Patent No. 2,112,157, U.S. Pat. Nos. 4,439,520, 4,433,048, 4,414,310 and 4,434,226.

The foregoing emulsion may be any emulsion of a surface latent image type that forms latent images on the surface of the grain, an internal latent image type that forms latent images inside the grain, and one that forms latent images on the surface and inside of the grain. To these emulsions, there may be added in the course of physical ripening or grain preparation a cadmium salt, lead salt, thallium salt, iridium salt or its complex salt, rhodium salt or its complex salt, or iron salt or its complex salt. To remove soluble salts, the emulsions may be subjected to washing such as noodle washing or flocculation precipitation, or to ultrafiltration. Favorable washing methods include a method that uses an aromatic hydrocarbon type aldehyde resin containing sulfo groups as described in Japanese Patent Examined Publication No. 16086/1960 and a method that uses High-molecular Flocculants G3, G8, etc. disclosed in Japanese Patent O.P.I. Publication No. 158644/1988.

The emulsions of the invention may use various photographic additives while physical ripening or chemical ripening proceeds, or before or after these processes. Examples of known additives are described in Research Disclosure Nos. 17643 (1978, Dec.) and 18716 (1979, Nov.). The following table shows the additives appeared in these two numbers by types together with locations of the description.

| | RD-17463 | | RD-18716 | |
|---|---|---|---|---|
| Additive | page(s) | category | page(s) | category |
| Chemical sensitizer | 23 | III | 648-upper right | |
| Sensitizing dye | 23 | IV | 648 right–649 left | |
| Development accelerator | 29 | XXI | 648-upper right | |
| Antifogging agent | 24 | VI | 649-lower right | |
| Stabilizer | 24 | VI | 649-lower right | |
| Antistaining agent | 25 | VII | 650 left-right | |
| Image stabilizer | 25 | VII | | |
| Ultraviolet absorbent | 25-26 | VIII | 649 right–650 left | |
| Filter dye | 25-26 | VIII | 649 right–650 left | |
| Whitening agent | 24 | V | | |
| Hardener | 26 | X | 651 left | |

-continued

| | RD-17463 | | RD-18716 | |
|---|---|---|---|---|
| Additive | page(s) | category | page(s) | category |
| Coating aid | 26-27 | XI | 650 right | |
| Surfactant | 26-27 | XI | 650 right | |
| Plasticizer | 27 | XII | 650 right | |
| Lubricant | 27 | XII | 650 right | |
| Antistatic agent | 27 | XII | 650 right | |
| Matting agent | 28 | XVI | 650 right | |
| Binder | 26 | IX | 651 left | |

Examples of the support applicable to the invention include those described in the foregoing Research Disclosure Nos. 17643 (on page 28) and 18716 (in the left column of page 647).

Suitable supports are plastic film and the like, and the surface of these supports may be subbed, or subjected to corona discharge or ultraviolet irradiation, for better adhesion to a coating layer. And an emulsion of the invention is coated on one side or both sides of the treated support.

The present invention is applicable to any of silver halide photographic light-sensitive materials, and particularly suitable for a high sensitive monochromatic light-sensitive material or a color light-sensitive material.

EXAMPLES

Example 1

500 ml of a 0.5 mol ammonical silver nitrate solution was added in 1 minute to 1l of a solution containing 130 g of potassium bromide, 2.5 g of potassium iodide, 30 mg of 1-phenyl-5-mercaptotetrazole and 15 g of gelatin under stirring at 40 ° C. 2 minutes after the addition, pH was adjusted to 6.0 with acetic acid. 1 minute after that, 500 ml of a solution containing 0.5 mol of silver nitrate was added in 1 minute and stirring was continued for 15 minutes. Then, a formaldehyde condensate of sodium naphthalene sulfonate and an aqueous solution of magnesium sulfate were added to coagulate the emulsion. After removing the supernatant, 2l of warm water of 40 ° C. was added, and stirring was continued for 10 minutes. Then, the aqueous solution of magnesium sulfate was added again to coagulate the emulsion, after which the supernatant was removed. Next, 300 ml of a 5% gelatin solution was added, and the mixture was stirred for 30 minutes at 55 ° C. The emulsion thus prepared had an average grain size of 0.40 μm, and 90% of the total number of grains ranged in size from 0.2 μm to 0.7 μm.

After adding sodium thiosulfate to the emulsion, sensitizing dyes represented by Formula I were added as a solution in the mixture shown in Table 1. Next, the emulsion was chemically ripened with the addition of ammonium thiocyanate and chloroauric acid. Further, 4-hydroxy-6-methyl-1, 3, 3a, 7-tetrazaindene was added in an amount of 1.0 g per mol silver halide, and then emulsion additives described below were added.

Separately, a polyethylene terephthalate base was subbed with a 10% wt aqueous suspension of a copolymer made from 50 wt% of glycydil methacrylate, 40 wt% of butyl methacrylate and 10 wt% of methyl methacrylate. Then, on one side of the subbed base was coated a backing solution containing 400 g of gelatin, 2 g of polymethylmethacrylate, 6 g of sodium dodecylbenzenesulfonate, 20 g of a antihalation dye described below, and glyoxal, simultaneously with coating of a protective coating solution containing gelatin, a matting agent, glyoxal, and sodium dodecylbenzene sulfonate. Thus, a support with a baking layer was prepared.

The coating weight of the backing layer and that of the protective layer were respectively 2.5 g/m$^2$ as gelatin.

[Antihalation dye]

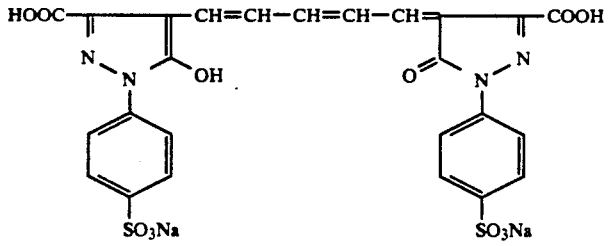

PREPARATION OF COATED SAMPLES

As emulsion additives, the following compounds were added to the emulsion in amounts per mol of silver halide.

| | |
|---|---|
| Diethylene glycol | 10 g |
| Nitrophenyl-triphenylphosphonium chloride | 50 mg |
| Ammonium 1,3-dihydroxybenzene-4-sulfonate | 1 g |
| Sodium 2-mercaptobenzimidazole-5-sulfonate | 10 mg |
| Topside 300 (made by Perma Chem. Asia Ltd.) | 1 mg |
| Polyacrylamide (mean molecular weight 40,000) | 10 g |
| 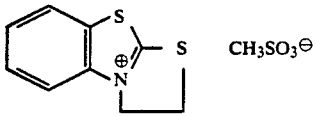 | 35 mg |
| 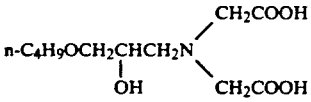 | 1 g |
| 1,1-dimethylol-1-bromo-1-nitromethane | 10 mg |
| 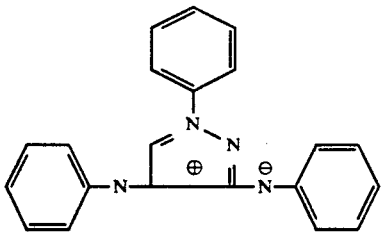 | 100 mg |
| Example dye 16 | 80 mg/m$^2$ |

Thus, the emulsion was made ready for coating, and then tested for standing stability at 35 ° C. under stirring by varying standing time as shown in Table 1.

Next, a protective coating solution was prepared by incorporating the following compounds with gelatin in an amount per gram of gelatin, i.e., 20 mg of

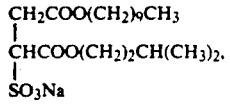

7 mg of matting agent comprising of silica particles with an average grain size of 7 μm, 70 mg of colloidal silica with an average grain size of 0.013 μm, a fluorine-containing surfactant or other than the fluorine-containing surfactant (their types and amounts are shown in Table 1), and a proper amount of exemplified hardener H-1

$CH_2{=}CHSO_2{-}CH_2OCH_2{-}SO_2CH{=}CH_2$.

On the above backed support were simultaneously coated two layers of the silver halide emulsion layer and the protective layer by a slide hopper method at a coating speed of 60 m/min to prepare samples. The amount of silver was 2.9 g/m$^2$, those of gelatin were 3 g/m$^2$ for the emulsion layer and 1.3 g/m$^2$ for the protective layer.

After being stored at 23 ° C and 55% RH for three days, these samples were exposed to a He-Ne laser beam at a condition of 1/100000 second per pixel (100 μm$^2$) under various light intensity, and then processed with an automatic processor Model SRX-501 made by Konica Corporation for 45 seconds in a developer and a fixer. Compositions of the developer and the fixer were as follows.

| | |
|---|---|
| Developer | |
| Potassium sulfite | 55.0 g |
| Hydroquinone | 25.0 g |
| 1-phenyl-3-pyrazolidone | 1.2 g |
| Boric acid | 10.0 g |
| Sodium hydroxide | 21.0 g |
| Triethylene glycol | 17.5 g |
| 5-nitrobenzimidazole | 0.10 g |
| Glutaraldehyde bisulfite | 15.0 g |
| Glacial acetic acid | 16.0 g |
| Potassium bromide | 4.0 g |
| Triethylenetetramine hexa acetateic acid | 2.5 g |
| Water added to | 1 l |
| Fixer | |
| Ammonium thiosulfate | 130.9 g |
| Anhydrous sodium sulfite | 7.3 g |
| Boric acid | 7.0 g |
| Acetic acid (90 wt %) | 5.5 g |
| Disodium ethylenediamine tetraacetate | 3.0 g |
| Sodium acetate trihydrate | 25.8 g |
| Aluminum sulfate 18-hydrate | 14.6 g |
| Sulfuric acid (50 wt %) | 6.77 g |
| Water added to | 1 l |

Surfactants Other Than The Fluorine-containing Surfactant

A

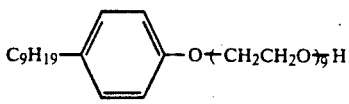

-continued

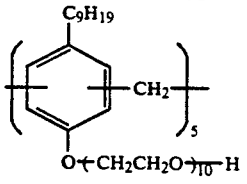

-continued

B

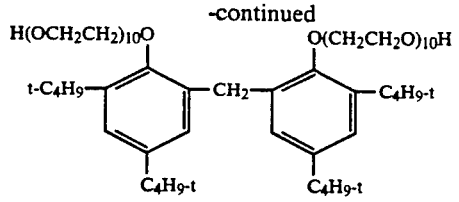

C

Comparative Sensitizing Dyes

Comparison-1

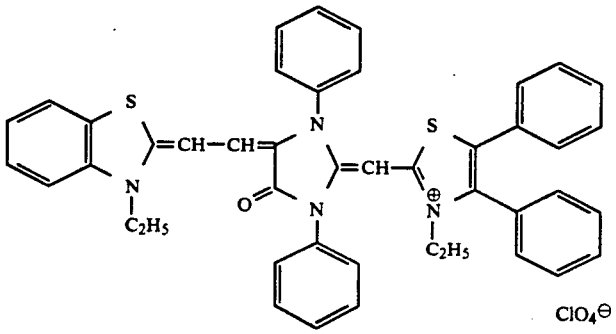

Comparison-2

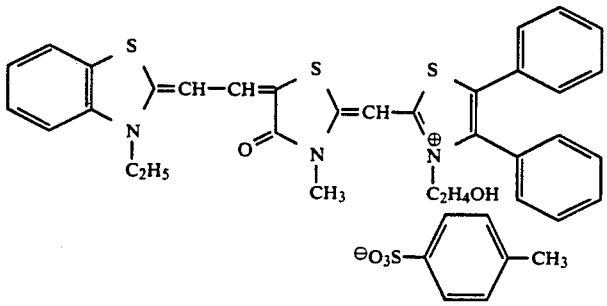

The developed samples were evaluated for the following properties.

γ(gradation):

A straight line portion of a characteristic curve that connects fog +0.25 density and 2.0 density.

Sensitivity:

A sensitivity relative to that of Sample 4 which is determined from an exposure necessary to give fog +1.0 density and set at 100.

The evaluation results are summarized in Table 1.

TABLE 1

| Sample No. | Compound of Formula I: Exemplified comp. | Compound of Formula I: (mg/mol Agx) | Water miscible solvent | Water miscible solvent: (ml/mol Agx) | Chain hydrocarbon compound: Exemplified comp. | Chain hydrocarbon compound: (g/mol Agx) | Fluorine-containing surfactant: Exemplified comp. | Fluorine-containing surfactant: (mg/m²) | Standing time of emulsion (35° C.) 0 hour: Fog | 0 hour: $S_2$ | 0 hour: γ | 4 hours: Fog | 4 hours: $S_2$ | 8 hours: Fog | 8 hours: $S_2$ | 12 hours: Fog | 12 hours: $S_2$ | Remarks |
|---|---|---|---|---|---|---|---|---|---|---|---|---|---|---|---|---|---|---|
| 1 | 23 | 60 | MeOH | 20 | 9 | 4 | F-32 | 10 | 0.03 | 160 | 2.4 | 0.03 | 158 | 0.03 | 158 | 0.03 | 158 | Invention |
| 2 | 23 | 80 | MeOH | 20 | 9 | 4 | F-32 | 10 | 0.03 | 170 | 2.5 | 0.03 | 170 | 0.03 | 168 | 0.03 | 167 | Invention |
| 3 | 23 | 100 | MeOH | 20 | 9 | 4 | F-32 | 10 | 0.03 | 185 | 2.6 | 0.03 | 184 | 0.03 | 184 | 0.03 | 184 | Invention |
| 4 | 23 | 80 | MeOH | 20 | — | 0 | F-32 | 10 | 0.03 | 100 | 1.8 | 0.04 | 88 | 0.06 | 79 | 0.10 | 75 | Comparison |
| 5 | 23 | 80 | MeOH | 22 | 9 | 2 | F-32 | 10 | 0.03 | 155 | 2.3 | 0.03 | 155 | 0.03 | 153 | 0.03 | 153 | Invention |
| 6 | 23 | 80 | MeOH | 16 | 9 | 8 | F-32 | 10 | 0.03 | 175 | 2.6 | 0.03 | 174 | 0.03 | 173 | 0.03 | 173 | Invention |
| 7 | 23 | 80 | MeOH | 8 | 9 | 16 | F-32 | 10 | 0.03 | 180 | 2.7 | 0.03 | 178 | 0.03 | 178 | 0.03 | 178 | Invention |
| 8 | 23 | 80 | EtOH | 20 | — | 0 | F-32 | 10 | 0.03 | 103 | 1.8 | 0.04 | 93 | 0.07 | 80 | 0.11 | 71 | Comparison |
| 9 | 23 | 80 | EtOH | 22 | 9 | 2 | F-32 | 10 | 0.03 | 150 | 2.4 | 0.03 | 150 | 0.03 | 151 | 0.03 | 150 | Invention |
| 10 | 23 | 80 | EtOH | 20 | 9 | 4 | F-32 | 10 | 0.03 | 170 | 2.5 | 0.03 | 168 | 0.03 | 168 | 0.03 | 168 | Invention |
| 11 | 23 | 80 | EtOH | 16 | 9 | 8 | F-32 | 10 | 0.03 | 175 | 2.5 | 0.03 | 174 | 0.03 | 174 | 0.03 | 175 | Invention |
| 12 | 23 | 80 | EtOH | 8 | 9 | 16 | F-32 | 10 | 0.03 | 180 | 2.7 | 0.03 | 179 | 0.03 | 179 | 0.03 | 178 | Invention |
| 13 | 8 | 80 | MeOH | 20 | — | 0 | F-32 | 10 | 0.03 | 105 | 1.9 | 0.04 | 100 | 0.05 | 92 | 0.10 | 85 | Comparison |
| 14 | 8 | 80 | MeOH | 20 | 9 | 4 | F-32 | 10 | 0.03 | 180 | 2.7 | 0.03 | 178 | 0.03 | 177 | 0.03 | 177 | Invention |
| 15 | 15 | 80 | MeOH | 20 | — | 0 | F-32 | 10 | 0.03 | 95 | 1.9 | 0.04 | 94 | 0.06 | 90 | 0.11 | 82 | Comparison |
| 16 | 15 | 80 | MeOH | 20 | 9 | 4 | F-32 | 10 | 0.03 | 170 | 2.6 | 0.03 | 169 | 0.03 | 169 | 0.03 | 169 | Invention |
| 17 | 19 | 80 | MeOH | 20 | — | 0 | F-32 | 10 | 0.03 | 107 | 2.0 | 0.05 | 102 | 0.08 | 95 | 0.10 | 88 | Comparison |
| 18 | 19 | 80 | MeOH | 20 | 9 | 4 | F-32 | 10 | 0.03 | 175 | 2.7 | 0.03 | 175 | 0.03 | 175 | 0.03 | 172 | Invention |
| 19 | 24 | 80 | MeOH | 20 | — | 0 | F-32 | 10 | 0.03 | 101 | 1.8 | 0.03 | 95 | 0.08 | 80 | 0.09 | 80 | Comparison |
| 20 | 24 | 80 | MeOH | 20 | 9 | 4 | F-32 | 10 | 0.03 | 175 | 2.6 | 0.03 | 174 | 0.03 | 174 | 0.03 | 174 | Invention |
| 21 | Comparative comp. 1 | 80 | MeOH | 20 | — | 0 | F-32 | 10 | 0.03 | 60 | 2.0 | 0.03 | 59 | 0.03 | 57 | 0.03 | 55 | Comparison |
| 22 | Comparative comp. 1 | 80 | MeOH | 20 | 9 | 4 | F-32 | 10 | 0.03 | 62 | 2.0 | 0.03 | 62 | 0.03 | 62 | 0.03 | 61 | Comparison |
| 23 | Comparative comp. 1 | 80 | MeOH | 16 | 9 | 8 | F-32 | 10 | 0.03 | 63 | 1.9 | 0.03 | 63 | 0.03 | 62 | 0.03 | 62 | Comparison |
| 24 | Comparative comp. 1 | 80 | MeOH | 8 | 9 | 16 | F-32 | 10 | 0.03 | 63 | 2.0 | 0.03 | 63 | 0.03 | 61 | 0.03 | 61 | Comparison |
| 25 | Comparative comp. 2 | 80 | MeOH | 20 | — | 0 | F-32 | 10 | 0.03 | 70 | 1.8 | 0.03 | 69 | 0.03 | 68 | 0.03 | 68 | Comparison |
| 26 | Comparative comp. 2 | 80 | MeOH | 20 | 9 | 4 | F-32 | 10 | 0.03 | 71 | 1.9 | 0.03 | 70 | 0.03 | 70 | 0.03 | 70 | Comparison |
| 27 | 23 | 80 | EtOH | 20 | 1 | 4 | F-32 | 10 | 0.03 | 170 | 2.5 | 0.03 | 171 | 0.03 | 170 | 0.03 | 169 | Invention |
| 28 | 23 | 80 | — | 0 | 1 | 25 | F-32 | 10 | 0.03 | 165 | 2.4 | 0.03 | 163 | 0.03 | 163 | 0.03 | 163 | Invention |
| 29 | 23 | 80 | EtOH | 20 | 2 | 4 | F-32 | 10 | 0.03 | 155 | 2.3 | 0.03 | 155 | 0.03 | 155 | 0.03 | 155 | Invention |
| 30 | 23 | 80 | EtOH | 20 | 3 | 4 | F-32 | 10 | 0.03 | 160 | 2.2 | 0.03 | 160 | 0.03 | 159 | 0.03 | 159 | Invention |
| 31 | 23 | 80 | EtOH | 20 | 4 | 4 | F-32 | 10 | 0.03 | 158 | 2.3 | 0.03 | 058 | 0.03 | 157 | 0.03 | 157 | Invention |
| 32 | 23 | 80 | EtOH | 20 | 5 | 4 | F-32 | 10 | 0.03 | 165 | 2.4 | 0.03 | 164 | 0.03 | 164 | 0.03 | 164 | Invention |
| 33 | 23 | 80 | EtOH | 0 | 6 | 4 | F-32 | 10 | 0.03 | 160 | 2.3 | 0.03 | 160 | 0.03 | 160 | 0.03 | 160 | Invention |
| 34 | 23 | 80 | EtOH | 20 | 7 | 4 | F-32 | 10 | 0.03 | 170 | 2.2 | 0.03 | 169 | 0.03 | 169 | 0.03 | 168 | Invention |
| 35 | 23 | 80 | EtOH | 20 | 8 | 4 | F-32 | 10 | 0.03 | 150 | 2.4 | 0.03 | 151 | 0.03 | 149 | 0.03 | 149 | Invention |
| 36 | 23 | 80 | EtOH | 20 | 10 | 4 | F-32 | 10 | 0.03 | 172 | 2.6 | 0.03 | 171 | 0.03 | 171 | 0.03 | 171 | Invention |
| 37 | 23 | 80 | EtOH | 20 | 11 | 4 | F-32 | 10 | 0.03 | 165 | 2.2 | 0.03 | 165 | 0.03 | 065 | 0.03 | 164 | Invention |
| 38 | 23 | 80 | EtOH | 20 | 12 | 4 | F-32 | 10 | 0.03 | 150 | 2.4 | 0.03 | 149 | 0.03 | 149 | 0.03 | 149 | Invention |
| 39 | 23 | 80 | EtOH | 20 | 9 | 4 | F-27 | 10 | 0.03 | 170 | 2.5 | 0.03 | 170 | 0.03 | 169 | 0.03 | 169 | Invention |
| 40 | 23 | 80 | EtOH | 20 | 9 | 4 | F-28 | 10 | 0.03 | 160 | 2.4 | 0.03 | 159 | 0.03 | 159 | 0.03 | 159 | Invention |
| 41 | 23 | 80 | EtOH | 20 | 9 | 4 | F-36 | 10 | 0.03 | 165 | 2.5 | 0.03 | 165 | 0.03 | 165 | 0.03 | 164 | Invention |
| 42 | 23 | 80 | EtOH | 20 | 9 | 4 | A | 10 | 0.03 | 140 | 2.2 | 0.03 | 135 | 0.03 | 125 | 0.05 | 120 | Invention |

TABLE 1-continued

| Sample No. | Compound of Formula I: Exemplified comp. | Compound of Formula I: (mg/mol Agx) | Water miscible solvent | (ml/mol Agx) | Chain hydrocarbon compound: Exemplified comp. | Chain hydrocarbon compound: (g/mol Agx) | Fluorine-containing surfactant: Exemplified comp. | Fluorine-containing surfactant: (mg/m²) | Standing time of emulsion (35° C.): 0 hour Fog | 0 hour $S_2$ | 0 hour γ | 4 hours Fog | 4 hours $S_2$ | 8 hours Fog | 8 hours $S_2$ | 12 hours Fog | 12 hours $S_2$ | Remarks |
|---|---|---|---|---|---|---|---|---|---|---|---|---|---|---|---|---|---|---|
| 43 | 23 | 80 | EtOH | 20 | 9 | 4 | B | 10 | 0.03 | 168 | 2.3 | 0.03 | 135 | 0.03 | 123 | 0.05 | 119 | Invention |
| 44 | 23 | 80 | EtOH | 20 | 9 | 4 | C | 10 | 0.03 | 135 | 2.2 | 0.03 | 130 | 0.04 | 120 | 0.05 | 115 | Invention |
| 45 | 07 | 80 | EtOH | 20 | — | 0 | F-32 | 10 | 0.03 | 108 | 1.9 | 0.04 | 100 | 0.07 | 92 | 0.10 | 88 | Comparison |
| 46 | 7 | 80 | EtOH | 20 | 9 | 4 | F-32 | 10 | 0.03 | 170 | 2.6 | 0.03 | 171 | 0.03 | 170 | 1.13 | 110 | Invention |
| 47 | 17 | 80 | EtOH | 20 | — | 0 | F-32 | 10 | 0.03 | 100 | 2.0 | 0.04 | 92 | 0.05 | 87 | 0.11 | 80 | Comparison |
| 48 | 17 | 80 | EtOH | 20 | 9 | 4 | F-32 | 10 | 0.03 | 165 | 2.5 | 0.03 | 165 | 0.03 | 065 | 0.03 | 164 | Invention |
| 49 | 23 | 80 | EtOH | 20 | 16 | 4 | F-32 | 10 | 0.03 | 167 | 2.4 | 0.03 | 166 | 0.03 | 166 | 0.03 | 166 | Invention |

MeOH: Methanol
EtOH: Ethanol

As apparent from Table 1, the samples of the invention did not cause so much increase in fogging and so much decrease in sensitivity as the comparative samples, and maintained stability of the photographic characteristics during a standing of the coating emulsion.

It is also understood that the coating emulsion in standing was further stabilized with the addition of a fluorine-containing surfactant.

What is claimed is:

1. In a silver halide photographic light-sensitive material comprising a support having thereon a silver halide emulsion layer containing silver halide grains which have been spectrally sensitized by addition of a sensitizing dye at any time between before the termination of desalination and before the termination of chemical aging, the improvement wherein said sensitizing dye is a compound represented by the following Formula I, said compound being added in a solution with a chain hydrocarbon compound having two or more hydroxy groups or a mixture of said hydrocarbon compound having two or more hydroxy groups and a water-miscible solvent.

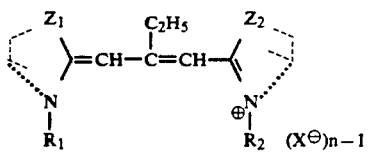

(I)

wherein $Z_1$, and $Z_2$, are independently a group of atoms necessary to form a benzothiazole nucleus, a benzoselenazole nucleus, a naphthothiazole nucleus or a naphthoselenazole nucleus, each of said nucleus may have a substituent; $R_1$, and $R_2$, are independently a substituted or unsubstituted lower alkyl group; X is an anion; and n is an integer of 1 or 2 provided that n is 1 when an intramolecular salt is formed.

2. A material of claim 1, wherein said chain hydrocarbon compound has 1 to 18 carbon atoms.

3. A material of claim 2, wherein said chain hydrocarbon compound has 1 to 12 carbon atoms.

4. A material of claim 3, wherein said chain hydrocarbon compound is selected from the group consisting of trimethylene glycol, propylene glycol, butylene glycol, pentamethylene glycol, triethylene glycol, hexamethlene glycol, decamethylene glycol, 1-methyl glycerol, erythritol, 1,2,3,4,-pentane tetrol, 2,3,3,4-tetramethyl-2,4,-pentane diol, 2,2,4-trimethyl-1.3-pentane diol, 2,4-dimethyl-hexane triol and trimethylol propane.

5. A material of claim 3, wherein said chain compound is ethylene glycol or glycerol.

6. A material of claim 1, wherein said water-miscible solvent is selected from the group consisting of methanol, ethanol, propanol, methyl cellosolve, halogeneated alcohols, aceton and pyridine.

7. A material of claim 6, wherein said water-miscible solvent is methanol, ethanol or acetone.

8. A material of claim 1, wherein said chain hydrocarbon compound is added to said silver halide emulsion in an amount of from 0.01 g to 200 g per mol of silver contained in said silver halide emulsion layer.

9. A material of claim 8, wherein said chain hydrocarbon compound is added to said silver halide emulsion in an amount of from 0.1 g to 80 g per mol of silver contained in said silver halide emulsion layer.

10. A material of claim 1, wherein the amount of said water-miscible solvent added to said silver halide emulsion with said chain hydrocarbon compound as the mixture is within the range of from 0.01 to 200 g per mol of silver halide contained in said silver halide emulsion.

11. A material of claim 10, wherein the amount of said water-miscible solvent added to said silver halide emulsion with said chain hydrocarbon compound as the mixture is within the range of from 0.1 to 80 g per mol of silver halide contained in said silver halide emulsion.

12. A material of claim 1, wherein at least one layer of said light-sensitive material contains a fluorine containing surfactant.

* * * * *